US009289103B2

(12) United States Patent
Jensen

(10) Patent No.: US 9,289,103 B2
(45) Date of Patent: Mar. 22, 2016

(54) EASY-INSTALL TOILET SEAT

(71) Applicant: AS IP Holdco, LLC, Piscataway, NJ (US)

(72) Inventor: Robert M. Jensen, East Brunswick, NJ (US)

(73) Assignee: AS IP Holdco, LLC, Piscataway, NJ (US)

( * ) Notice: Subject to any disclaimer, the term of this patent is extended or adjusted under 35 U.S.C. 154(b) by 82 days.

(21) Appl. No.: 14/164,187

(22) Filed: Jan. 25, 2014

(65) Prior Publication Data

US 2014/0215700 A1 Aug. 7, 2014

Related U.S. Application Data

(60) Provisional application No. 61/761,580, filed on Feb. 6, 2013.

(51) Int. Cl.
*A47K 13/12* (2006.01)
*A47K 13/26* (2006.01)

(52) U.S. Cl.
CPC ..... *A47K 13/26* (2013.01); *Y10T 29/49826* (2015.01)

(58) Field of Classification Search
CPC ..... A47K 13/26
USPC ..... 4/236, 240
See application file for complete search history.

(56) References Cited

U.S. PATENT DOCUMENTS

| | | | | |
|---|---|---|---|---|
| 4,079,471 | A | 3/1978 | Corda | |
| 4,319,365 | A | 3/1982 | Bemis | |
| 4,416,048 | A | 11/1983 | Otte | |
| 4,985,939 | A | 1/1991 | Otte | |
| 5,918,321 | A | 7/1999 | Olle | |
| 5,933,875 | A | 8/1999 | Hulsebus | |
| 6,070,295 | A | 6/2000 | Hulsebus | |
| 6,101,640 | A | 8/2000 | Brewer | |
| RE3,719 | E | 5/2001 | Iida et al. | |
| 6,453,478 | B1 | 9/2002 | Semmler | |
| D481,924 | S | 11/2003 | Hulsebus | |
| 6,763,529 | B1 | 7/2004 | Richter | |
| D510,253 | S | 10/2005 | Twomey | |
| 7,155,748 | B2 | 1/2007 | Vierkant, III | |
| 7,203,975 | B2 * | 4/2007 | Vierkant, III | A47K 13/26 4/236 |

(Continued)

FOREIGN PATENT DOCUMENTS

| | | |
|---|---|---|
| EP | 0619976 A1 | 3/1994 |
| EP | 0856275 B1 | 1/1998 |

(Continued)

*Primary Examiner* — Huyen Le
*Assistant Examiner* — Christine Skubinna
(74) *Attorney, Agent, or Firm* — Flaster/Greenberg P.C.

(57) ABSTRACT

A toilet seat hinge assembly and method of installing the assembly are described, wherein the assembly includes a hinge body having a seat and a central opening extending longitudinally through the body; a fastening hinge post having a head, a longitudinally extending body and at least one locking pin; a bushing having an upper flange portion and a longitudinally extending body defining a longitudinally extending channel therethrough, which body further has at least one transversely extending groove in or on the bushing body; and at least one fastening device for securing the hinge assembly to a toilet. The at least one locking pin locks the assembly by rotation of the fastening hinge post body within the channel in the bushing body.

24 Claims, 13 Drawing Sheets

(56) References Cited

U.S. PATENT DOCUMENTS

| | | | | |
|---|---|---|---|---|
| 7,281,276 | B2 | 10/2007 | Vierkant, III | |
| 7,490,366 | B1 | 2/2009 | Richter | |
| D588,899 | S | 3/2009 | Lucchini | |
| D614,474 | S | 4/2010 | Edwards | |
| 8,074,302 | B1 * | 12/2011 | Kook | A47K 13/12 16/365 |
| 2003/0182719 | A1 | 10/2003 | Glesson | |
| 2006/0064807 | A1 | 3/2006 | Vierkant, III | |
| 2006/0113504 | A1 | 6/2006 | Tollin | |
| 2007/0089222 | A1 * | 4/2007 | Leibfried | A47K 13/26 4/236 |
| 2008/0209620 | A1 | 9/2008 | Hand | |
| 2009/0000017 | A1 | 1/2009 | Zhou | |
| 2009/0106884 | A1 | 4/2009 | Bemis | |
| 2009/0113610 | A1 | 5/2009 | Lin | |

FOREIGN PATENT DOCUMENTS

| | | | |
|---|---|---|---|
| EP | 0997096 | A1 | 10/1998 |
| EP | 1616520 | B1 | 6/2005 |
| GB | 02447861 | A | 10/2008 |
| JP | 09140630 | A | 6/1997 |
| JP | 21025449 | A | 1/2001 |
| WO | 9111950 | A1 | 8/1991 |

* cited by examiner

EASY-INSTALL TOILET SEAT

CROSS-REFERENCE TO RELATED APPLICATIONS

This reference claim the benefit under 35 U.S.C. §119(e) of U.S. Provisional Patent Application No. 61/761,580, filed Feb. 6, 2013 the disclosure of which is incorporated by reference herein in its entirety.

BACKGROUND OF THE INVENTION

1. Field of the Invention

The invention relates to a hinge assembly for attachment and release of a toilet seat with or without the use of tools, and more particularly to a toilet seat hinge assembly with a rotational lock and unlock feature for simple installation and/or removal.

2. Description of Related Art

Toilet seats are known to be fastened to toilet bowls by passing a bolt through one or more holes formed in an extended flange portion of a toilet seat or toilet seat and lid assembly, through holes formed in the rear of a toilet bowl, and then securing the fastener by a standard nut and/or the use of a various hinge connection or hinge post assemblies, some of which are very complex. Many hinge assemblies are good at securing the seat and/or seat and lid assembly to the bowl, but cleaning around the hinge assemblies or the ease of removal for cleaning the bowl present issues. Further removal to replace the seat for maintenance purposes can also present problems. Installation can also prove difficult in complex designs or present difficulty in removing bolt/nut hinge assemblies. As toilet seats and lids have improved over time, hinge assemblies have been developed that allow for easier cleaning by making a toilet seat that is easier to remove and/or install on the toilet bowl.

U.S. Pat. No. 5,933,875 teaches a hinge and latch assembly for detachable connection of a seat to a toilet, including easy removal for cleaning. It includes a base and a hinge support member. The base has a downwardly extending portion through which a bolt passes. The base is made so as to receive a locking connector. A hinge support member then fits over the base like a cover piece to prevent rotation and to support the connection of the hinge. Once the base member is in place and the bolt secured, the hinge support member can be placed on top of the base member and then the locking member inserted into the opening in the hinge support member so as to lock the device in a releasable manner.

U.S. Pat. No. 6,070,295 describes a hinge assembly having a threaded mounting post, a hinge post, and a latch member. The mounting post can be fixed to a toilet bowl and the hinge post pivotally connected to a toilet seat over the mounting post. The latch member engages the mounting post head in an annular recess to prevent unwanted upward movement of the hinge post while locked and to secure the toilet seat relative to the toilet bowl. The hinge assembly is mounted to the toilet by fastening the mounting post to the toilet with a nut beneath a flange.

U.S. Pat. No. 7,203,975 teaches a quick-release hinge connection having a segmented base section that fits around a bolt and which is configured to interlock with a hinge support piece having an extension for receiving a hinge pin. The hinge support piece is placed over the bolt so that the base is around the head of the bolt and the base interlocks with the hinge support piece.

While such easy removal hinge support devices are known, there is still a need in the art to improve upon these designs to provide a device that is not only economical to manufacture by minimizing the number of parts, but that is also easy to lock in place and unlock and release for cleaning and/or replacement. There is also a need in the art to continue generally to provide improvements for consumers and plumbers in ease of assembly and installation of toilet seats or toilet seat and lid assemblies to toilet bowls.

BRIEF SUMMARY OF THE INVENTION

The present invention includes a toilet seat hinge assembly for a toilet bowl, comprising: a fastening hinge post having a head and a longitudinally extending body having at least one locking pin; a bushing having an upper flange portion, a longitudinally extending body, the body defining a longitudinally extending channel therethrough that is configured to receive the fastening hinge post body and at least one locking pin, and at least one transversely extending groove in or on the bushing body configured for receiving the at least one locking pin; a hinge body defining a seat configured to receive the fastening hinge post head; a central opening extending longitudinally through the seat of the hinge body, wherein the central opening is configured to receive the fastening hinge post body and the at least one locking pin therethrough; and at least one fastening device for securing the hinge assembly to a toilet, wherein the at least one locking pin is configured to lock by rotating the fastening hinge post body within the longitudinally extending channel of the bushing body until the locking pin is positioned within the at least one transversely extending groove.

In one embodiment, the locking pin is configured to unlock by rotating the fastening hinge post body within the channel of the bushing body in a direction opposite of a locking rotation direction until the locking pin is no longer positioned within the at least one transversely extending groove. The hinge body may be formed as a unitary structure. The hinge body may also further comprise a hinge pin receiving portion configured to receive a hinge pin.

Whether unitary or two portions connected together by welding, snap-fit or adhesive, the hinge body may be formed so as to comprise an upper section and a lower section, the upper section comprising the hinge pin receiving portion and the seat, and the lower section having an upper surface in facing engagement with a lower surface of the upper section, and having on a lower surface thereof a fastening hinge post receiving insert that extends through the seat of the upper section to the lower surface, wherein the fastening hinge post receiving insert is configured to receive the upper flange portion of the bushing.

The hinge pin receiving portion preferably also comprises a channel configured for receiving a hinge pin of a toilet seat or toilet seat and lid assembly.

The fastening hinge post may comprise a material selected from the group consisting of aluminum, aluminum alloys, copper, copper alloys, moldable composites, moldable polymeric materials, and combinations thereof. In preferred embodiments, the moldable polymeric materials are selected from the group consisting of polyethylene, polypropylene, polyvinyl chloride (PVC), moldable fluoropolymers, and blends and copolymers thereof, In another embodiment, the fastening hinge post comprises brass.

The fastening hinge post body is preferably capable of rotating within the at least one transversely extending groove of the bushing body about ±1 degree to about ±90 degrees for locking the assembly, and preferably about ±45 degrees to about ±90 degrees. The fastening hinge post body is further capable of rotating within the at least one transversely extending groove of the bushing body about ±1 degree to about ±90 degrees for unlocking the assembly in a direction opposite a direction for locking the hinge assembly, preferably about ±45 degrees to about ±90 degrees.

In one embodiment, the bushing comprises a material selected from the group consisting of aluminum, copper, stainless steel, brass, bronze, moldable composites, moldable polymeric materials including polyethylene, polypropylene, polystyrene, polyvinyl chloride (PVC), and polytetrafluoroethylene (PTFE) and copolymers thereof, and/or combinations thereof, and preferably polyvinyl chloride (PVC).

The invention further includes a method of installing a toilet seat on a toilet, comprising: (a) providing a toilet seat having a toilet seat hinge; (b) providing at least one toilet seat hinge assembly comprising: a fastening hinge post having a head and a longitudinally extending body having at least one locking pin; a bushing having an upper flange portion, a longitudinally extending body, the body having a longitudinally extending channel therethrough configured to receive the fastening hinge post body and the at least one least one locking pin, and at least one transversely extending groove in the bushing body configured for receiving the at least one locking pin; a hinge body defining a seat configured to receive the fastening hinge post head; a central opening extending longitudinally through the seat of the hinge body, wherein the central opening is configured to receive the fastening hinge post body and the locking pin therethrough; and at least one fastening device for securing the hinge assembly to a toilet, wherein the at least one locking pin is configured to lock by rotating the fastening hinge post body within the channel in the bushing body until the locking pin is positioned within the at least one transversely extending groove; (c) positioning the bushing into a mounting hole in a toilet; (d) securing the bushing within a mounting hole in a toilet with the fastening device; (e) placing the hinge body over the bushing; (f) inserting the fastening hinge post through the hinge body and the longitudinally extending channel of the bushing body until the fastening hinge post head is within the seat; (g) rotating the fastening hinge post until the at least one locking pin is within the at least one transversely extending groove to lock the hinge assembly; and (h) mounting the toilet seat hinge on the hinge assembly.

In one embodiment of the method, the hinge body may comprise a lower seat portion configured to receive the upper flange portion of the bushing and step (e) of the method may then further comprise placing the hinge body over the bushing so that the upper flange portion of the bushing is situated in the lower seat portion of the hinge body.

Also, in the method, the toilet seat may be a standalone toilet seat or part of a toilet seat and lid assembly.

Step (b) of the method may include providing two hinge assemblies such that steps (c) through (g) are to be carried out for each of the hinge assemblies. In such an embodiment, each of the two hinge bodies of the two hinge assemblies may have a hinge pin receiving portion configured to receive a hinge pin, and the toilet seat preferably has a hinge pin. In the method, step (h) would then further comprise positioning the toilet seat hinge in the hinge pin receiving portions of the two hinge bodies.

In one embodiment of the above method, the at least one hinge body has a hinge pin receiving portion configured to receive a hinge pin, the toilet seat has a hinge pin and step (h) further comprises positioning the toilet seat hinge in the hinge pin receiving portions of the hinge bodies.

In step (g) of the method, the rotating step may further comprise rotating the fastening hinge post about ±1 degrees to about ±90 degrees for locking, preferably about ±45 degrees to about ±90 degrees.

The method may also comprise the step of unlocking the hinge assembly for removal of the installed toilet seat by rotating the fastening hinge post in a direction opposite a locking direction for the hinge assembly to unlock the hinge assembly, wherein the degree of rotation can extend in the unlocking direction about ±1 degrees to about ±90 degrees for unlocking, preferably about ±45 degrees to about ±90 degrees.

BRIEF DESCRIPTION OF THE SEVERAL VIEWS OF THE DRAWING(S)

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
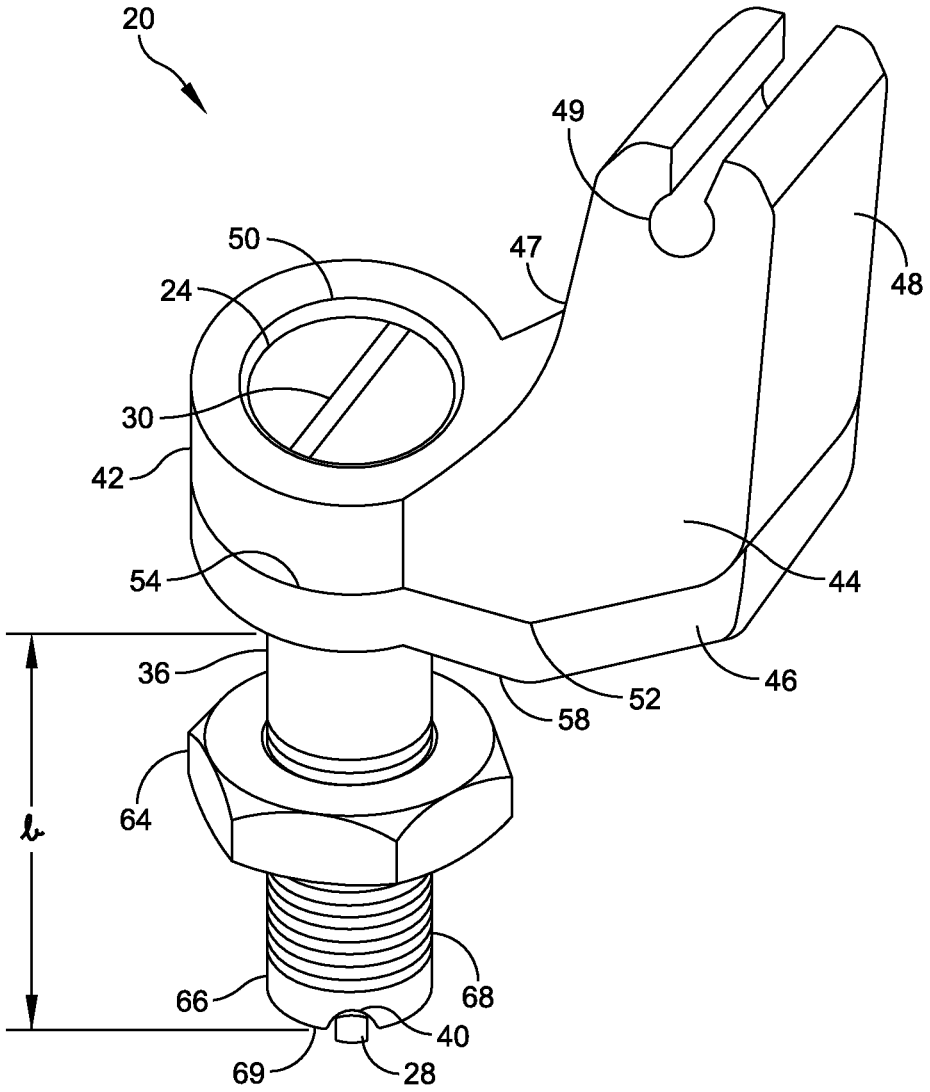
FIG. 1 is a perspective view of a toilet seat hinge assembly according to one embodiment of the invention.
Figure 2:
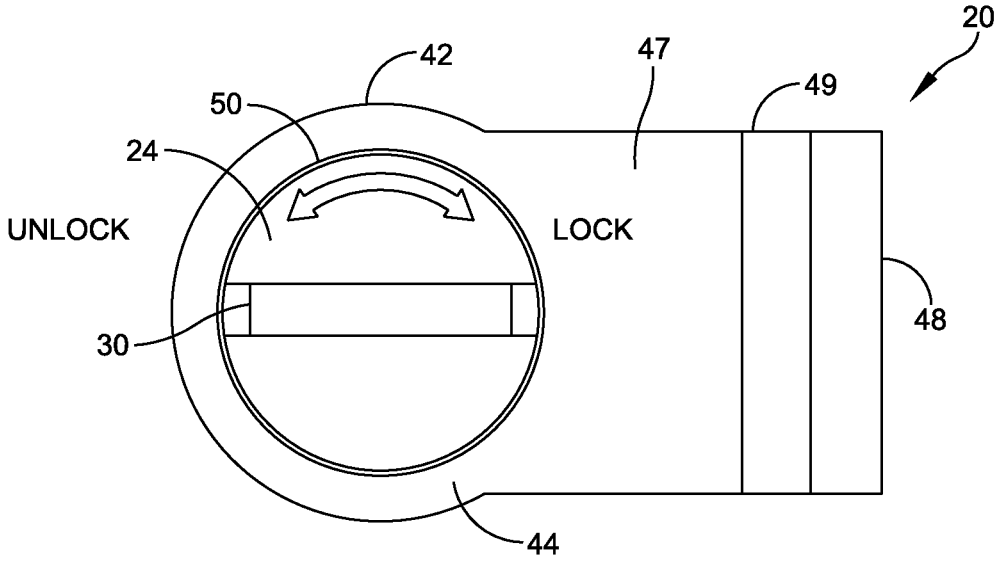
FIG. 2 is a top plan view of the toilet seat hinge assembly of FIG. 1.
Figure 3:
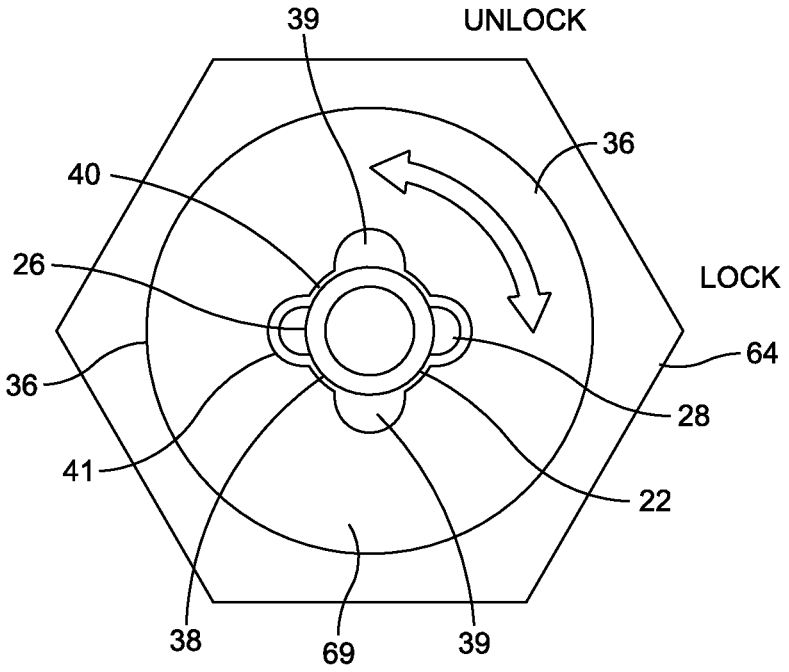
FIG. 3 is a bottom plan view of the toilet seat hinge assembly of FIG. 1.

The invention includes a toilet seat hinge assembly for use in installing a toilet seat, which may be part of a toilet seat and lid assembly, to a toilet bowl. It also includes methods for installing or removing a toilet seat using the toilet seat hinge assembly(ies) herein. The toilet seat hinge assemblies described herein eliminate the need for costly tools, and virtually eliminate difficulty in reaching areas on the toilet near or under the hinge assembly for thorough cleaning of a toilet and a toilet seat. Removal of the toilet seat for maintenance is also easier than for a standard or conventional seat.

A toilet seat as used herein is intended to encompass both two-piece, toilet seat and lid assemblies or seats without lids, which are configured to have a hinge or hinge pin that is configured for attaching or mounting to the hinge assembly (ies) herein. The lid, if present, can be integrally or separately attached to a seat. The preferred assemblies are configured to work with standard toilet lids having hinge pins for mounting to the assemblies.

Certain terminology may be used in the following description for convenience only and should not be considered to be limiting. For example, words such as "left," "right," "upper," "lower," "top," "bottom," "front," "rear" and "back" designate directions in the drawings to which reference is made. Likewise, the words "inwardly" and "outwardly" are directions toward and away from, respectively, the geometric center of the referenced object. The terminology includes the words above specifically mentioned, derivatives thereof, and words of similar import.

Figure 11A:
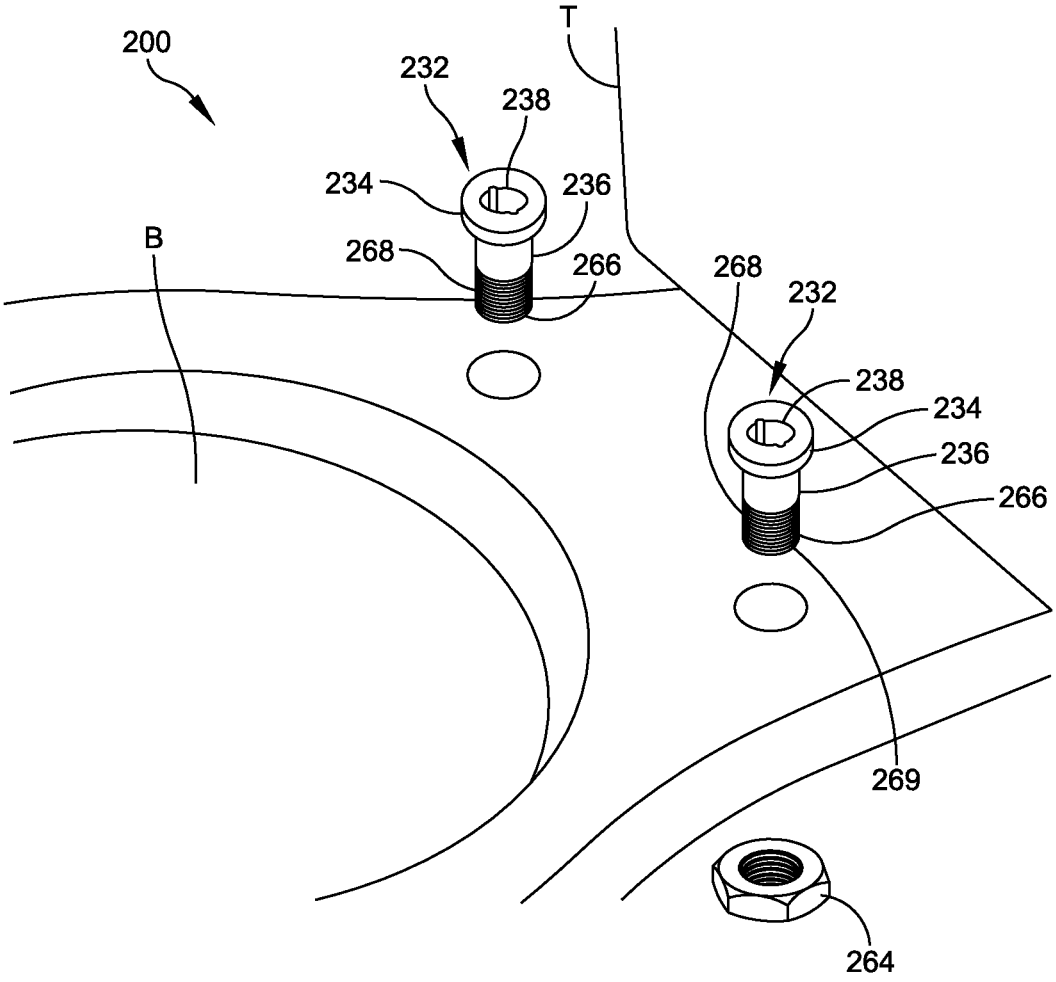
FIG. 11A is a perspective representation of a step of a method herein showing positioning of the bushing of the embodiment of the assembly of FIG. 10 into a mounting hole on a toilet.

With reference to FIGS. 1-11C, a toilet typically includes a tank T and a bowl B (see FIG. 11A). It should be understood, however, that toilets that are line-installed and do not require a tank can also benefit from the invention herein. The toilet is preferably used with a detachable toilet seat, which may be part of a toilet seat and lid assembly 10 as shown herein. The toilet seat and lid assembly 10 includes at least one toilet seat hinge assembly. The assembly of FIGS. 1-5B and fastener of FIG. 7 are referred to herein as hinge assembly 20 and related modified embodiments are also shown and identified herein as hinge assemblies 120, 220, and 320, each of which is configured for attaching a toilet seat, such as that in toilet seat and lid assembly 10, to a bowl, such as bowl B. Each one of the above items for use on a toilet is described in further detail herein below.

FIGS. 1-5B and 7A show a first embodiment of a toilet bowl hinge assembly described herein. The toilet bowl hinge assembly 20 of the first toilet assembly 10 has a fastening hinge post 22. The post 22 has a head 24, a longitudinally extending fastening hinge post body 26 and at least one locking pin 28.

The hinge assembly 20 also includes a bushing 32. The bushing has an upper flange portion 34, a longitudinally extending body 36 defining therein a longitudinally extending channel 38 which extends through the bushing from the upper flange portion 34 through the entire bushing to the opposite end of the bushing body 36. The channel 38 is configured to receive the fastening hinge post body 26. The bushing body 36 also has at least one transversely extending groove 40 in or on the bushing body 36. Each such groove is preferably configured for receiving at least one locking pin 28 on the fastening hinge post body 26 when the post is locked after locking rotation in the assembly as described further below.

The hinge assembly 20 further includes a hinge body 42 which may be a unitary body or formed in two or more separate sections and then assembled together. If formed separately, the sections may be joined using any method known or to be developed in the art, including ultrasonic welding, adhesive, heated press welding or a snap fit assembly.

As shown in the embodiment of hinge assembly 20, the hinge body 42 has an upper section 44 and a lower section 46. The upper section 44 of hinge body 42 includes an extension surface 47 that defines a hinge pin receiving portion 48. The hinge pin receiving portion is configured to receive a hinge pin from toilet seat and lid assembly 10. The hinge upper section 44 also includes at least one seat 50 configured to receive the head 24 of the fastening hinge post 22.

If formed of separate pieces, the lower section 46 may have an upper surface 52 that is in facing engagement with a lower surface 54 of the upper section 44 of the hinge body 42, and preferably permanently attached such as by molding, welding, gluing or other interlocking device or fastener system as noted above. The lower section 46 may optionally also have a preferred fastening hinge post receiving insert 56, which insert 56 can extend through the seat 50 in the upper section 44. The fastening hinge post receiving insert 56 at its upper end is configured to receive a fastening hinge post at the location where the head 24 joins the top of the hinge post body 26 (see FIG. 4).

The lower surface 58 of the lower section 46 of the hinge body 42 preferably also has a further seat 60 configured to receive the upper flange portion 34 of the bushing 32. The hinge body 42 defines a central opening 62 that extends longitudinally through the hinge body 42 from the upper seat 50 in the upper section 44, and through the fastening hinge post receiving insert 56 in the lower section 46. The central opening 62 of the hinge body 42 is preferably sized and configured to receive the body 26 of the fastening hinge post 22 therethrough.

The hinge assembly(ies) herein also each preferably include at least one fastening device for securing or connecting the hinge assembly(ies) to the toilet. As shown in FIG. 7, a fastening device 64 in the form of a nut may be used for connecting the hinge assembly 20 to a toilet such as toilet T. The one locking pin 28 as shown in FIGS. 1-5B is configured to reversibly lock by'rotating the body 26 of the fastening hinge post 22 within the at least one longitudinally extending channel 38 of the body 36 of the bushing 32 until the locking pin is situated in a transversely extending groove 40 in or on the bushing body 36, after the fastening hinge post 22 is positioned within the longitudinally extending channel 38 in the bushing 32.

The fastening hinge post 22 is a mechanism which can be rotated to lock or unlock the hinge assembly 20 to install it securely on a toilet. The fastening hinge post 22 can be formed by molding or otherwise forming it from materials that are preferably fluid-resistant and also preferably not susceptible to corrosion, for example, aluminum, copper, and alloys including, e.g., steel, bronze and brass, moldable composites, and moldable polymeric materials, and/or combinations of these materials. Suitable moldable polymeric materials (which may be filled to form composites or unfilled materials) include, but are not limited to, polyethylene, polypropylene, polyvinyl chloride (PVC), and polytetrafluoroethylene (PTFE) and copolymers and blends thereof. In a preferred embodiment, the fastening hinge post 22 is formed from brass.

In one embodiment, the fastening hinge post 22 has a head 24 that is shaped to fit inside of the seat 50 in the upper section of the hinge body 42. The head 24 can be shaped and sized in any way that is complementary to and preferably fits snugly within the seat 50, provided that the seat 50 is shaped in a manner to accommodate the head 24 and still allow the head 24 to rotate for locking and unlocking rotation is use, including shapes such as generally circular, square, rectangular, oblong or triangular. In a preferred embodiment, the head 24 has a circular shape with a longest dimension, for example, a diameter $d_1$ measured transversely across the head of about 2.0 cm to about 3.0 cm, and more preferably about 2.0 cm to about 2.5 cm.

The head 24 of the fastening hinge post head 22 may have a slot such as slot 30 that allows the head 24 to be easily rotated in the hinge assembly 20 with the use of simple tools to apply torque for rotation as are known in the art or to be developed, such as screwdrivers, coins, knives and similar flat-headed devices. In addition, a custom-shaped tool can also be adopted for use with a particular upper hinge body seat and complementary hinge post head if desired. However, it is desirable to select a tool and hinge post head of the least complex design if possible for ease of manufacturing.

In an alternative embodiment of a hinge assembly 220 as shown in FIGS. 8-11C, a head 224 of a hinge post 222, instead of slot such as slot 30, includes a tab 270 that allows the head 224 to be gripped manually by a user and rotated within the hinge assembly 220 to either a locked or unlocked position without the need for using tools, although gripping tools may be used if desired, such as pliers or vice grips. In the assembly 220, like numbers are used for like elements throughout with analogous function and so may be as described elsewhere herein unless otherwise distinguished.

With reference to the hinge assembly 20, the fastening hinge post 22 has a longitudinally extending body 26 that is of a length l sufficient to extend the body 26 through the body 36 of the bushing 32 until the locking pin 28 engages a transversely extending groove, such as groove 40. Preferably, the length l measured longitudinally along the body of the body 26 of the post 22 is about 2.5 cm to about 6 cm, and more preferably about 5 cm to about 6 cm, depending on the thickness and width of the installation surface on the back of the toilet bowl B. The width of the fastening hinge post body 26 as measured transversely across the body must be sufficient to fit snugly inside of the body 36 of the bushing 32 while still allowing for ease of rotation. Preferably, the fastening hinge post 22 has a body 26 that is generally cylindrical and has a diameter $d_2$ measured transversely across a main portion of the length of the body of about 0.6 cm to about 1.8 cm, and preferably about 0.6 cm to about 1.2 cm. The diameter $d_2$ of the body 26 is preferably generally less than the diameter $d_1$ of the fastening hinge post head 24. The body 26 can be either fixedly attached to the center of an underside of the hinge post head 24 or, more preferably, is integrally formed with the head 24 of the hinge post 22 in the manner of a standard bolt.

The body 26 of the fastening hinge post 22 preferably also has at least one locking pin 28 formed, attached, or inserted transversely through the body 26 and positioned somewhere along the length l of the body 26. The locking pin 28 can be retractably mounted into the fastening hinge post body 26, for example, by spring loading the locking pin 28 into the fastening hinge post body 26. Preferably, the locking pin 28 is formed from the same or similar materials as the fastening hinge post 22. The locking pin 28 is preferably also sized and shaped or otherwise configured to be capable of fitting through and engaging for locking a transversely extending groove 40 in or on the body 36 of the bushing 32 or disengaging from such a groove 40 for unlocking the hinge assembly 20. Preferably, the locking pin 28 has a length $l_2$ measured longitudinally along the body 26 consistent with the groove of about 6 cm to about 7 cm.

The bushing 32 is a generally cylindrical housing configured to be inserted into a mounting hole of a toilet bowl B and to have an upper flange portion that fits in the seat 60 provided on a lower section or bottom of the hinge body 42. The bushing is configured so as to retain at least a portion of the fastening hinge post 22 within the assembly with the head 24 located and situated above the hinge body 42 and above the mounting hole in the toilet and at least a portion of the body 26 of the fastening hinge post 22 below the mounting hole within the bushing. The body 36 of the bushing is used to secures the seat hinge assembly 20 to the toilet generally by use of a fastener such as that shown in FIG. 7. The bushing 32 can be assembled from two halves that also may be individually molded or separately molded as an independent piece. In either case, it is formed and/or tunneled out, such as by machining, to include a longitudinally extending channel 38 and at least one transversely extending groove 40 in or on the bushing body 36. The bushing 32 is formed by molding or other forming materials that are fluid-resistant and preferably not susceptible to corrosion, for example, aluminum, copper, alloys including, e.g., stainless steel, bronze and brass, or moldable composites, moldable polymeric materials, and/or combinations of these materials, such as filled and unfilled polyethylene, polypropylene, polystyrene, polyvinyl chloride (PVC), and polytetrafluoroethylene (PTFE) as well as copolymers and blends of such materials. In a preferred embodiment, the bushing 32 is formed from polyvinyl chloride (PVC).

The bushing 32 includes an upper flange portion 34, which is configured to complement and fits within the seat 60 in the lower surface 58 of the lower section 46 of the hinge body 42. The upper flange portion 34 can be shaped, sized or otherwise configured to extend when measured so as to have a diameter that is at least about 0.25 inch to about 0.5 inch wider, measured transversely, than the diameter of a standard toilet seat mounting hole in the toilet. Thus, the upper flange portion 34 will rest on top of the toilet bowl B while the body of the bushing passes through the mounting hole but the upper flange portion would not pass through the mounting hole. Further, the upper flange portion 34 is preferably shaped in a way that to fit within a corresponding seat 60 in the lower surface 58 of the lower section 46 of the hinge body 42. The seat 60 and the upper flange portion 34 may each be generally circular, square, rectangular, oblong or triangular.

In one embodiment, the upper flange portion 34 has a circular shape with a longest dimension, for example, a diameter $d_3$, measured transversely across the flange portion of about 2.0 cm to about 3.0 cm, and more preferably about 2.0 cm to about 2.5 cm, which is preferably at least about 0.25 inch or more greater than a standard toilet mounting hole, which is typically 1.3 cm. Should a different sized mounting hole be formed in a toilet, the size of the parts of the assembly, including the bushing may be adjusted to work with the size of the mounting hole accordingly.

The bushing 32 also contains a longitudinally extending body 36 that defines a longitudinally extending channel 38 therethrough. The channel 38 is preferably configured to receive the body 26 of the fastening hinge post 22 by molding and/or boring through the body 36 of the bushing 32 so that the channel has a corresponding transverse and longitudinal shape to receive the body 26 of the fastening hinge post 22. The longitudinally extending body 36, like the fastening hinge post body 26, is of a sufficient length l to extend through the thickness of the installation surface in the chinaware of the toilet bowl B, and preferably also extend through the bottom of the chinaware to receive a mating fastening device 64, to fasten or otherwise secure a the toilet seat 10 in place on a toilet using the assembly 20. Preferably, the length 1 of the longitudinally extending body 36 is about 4 cm to about 6 cm, and more preferably about 4 cm to about 5 cm, depending on the thickness of the toilet installation surface having the mounting hole(s) on the back of the toilet bowl B.

Figure 5A:
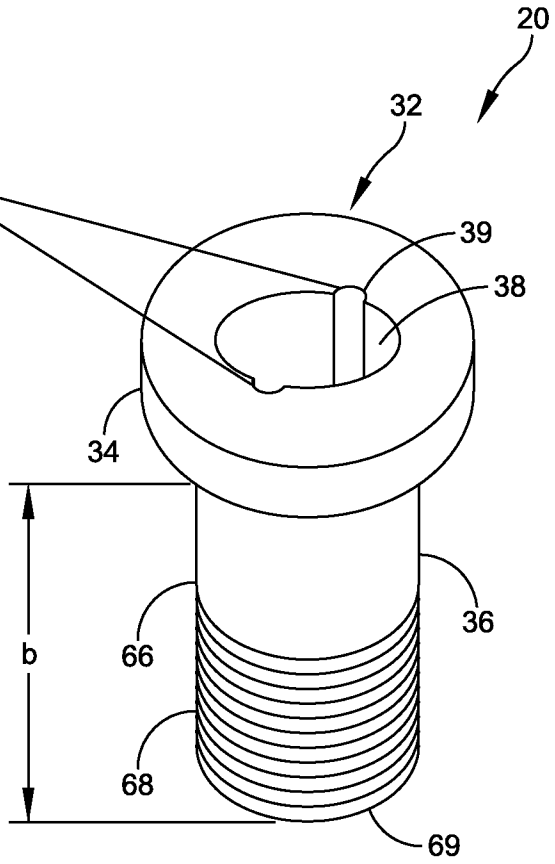
FIG. 5A is a perspective view of the bushing in the assembly of FIG. 1.
Figure 5B:
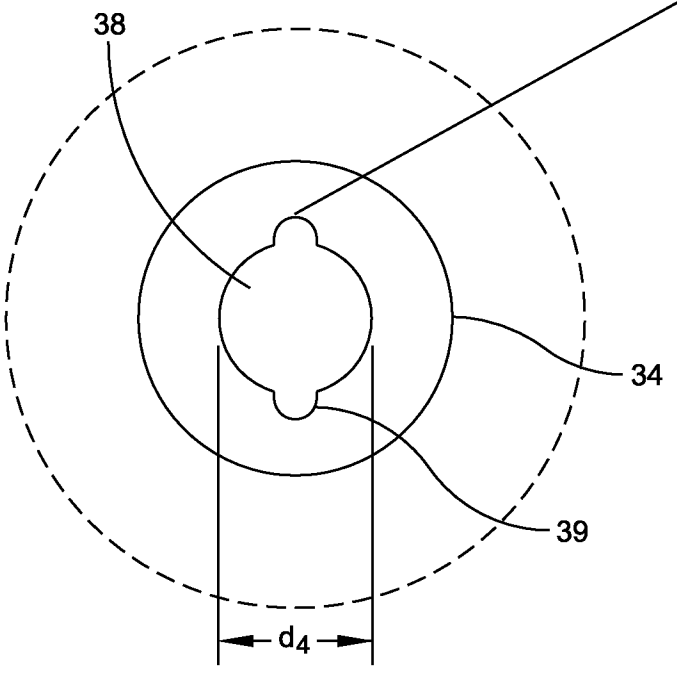
FIG. 5B is a top plan view of the bushing of FIG. 5A.

The longitudinally extending channel 38 extending through the bushing 32 is shaped to receive the fastening hinge post body 26. The channel 38 is preferably shaped to have at least one transversely extending groove 40 along its length (however a transversely extending groove may be formed at the bottom of the channel at the very end thereof so as to position the groove on the bushing body extending from the channel). The channel 38 may also have at least two additional locking pin passages 39 each of which may be positioned on opposite sides of the channel 38 in the bushing body 36 along its length so as to easily receive passage of the at least one locking pin 28 to allow it to slide longitudinally through the body 36 of the bushing 32 in an unlocked position if the locking pin is one that is not retractable (if the pin is retractable, the locking pin passages 36 may be optional). This is best shown in FIGS. 5A and B.

The diameter $d_4$ of the channel 38 as measured transversely across the channel in a direction perpendicular to the transverse direction of any locking pin passages 39, is about 0.6 cm to about 1.9 cm, and preferably about 0.6 cm to about 1.3 cm, which corresponds closely to the diameter $d_2$ of the fastening hinge post body 26 so as to provide a snug fit upon assembly.

The body 36 of the bushing 32 has at least one transversely extending groove 40 partially formed either on the bottom 69 of the body 36 of the bushing 32 or partially or completely formed within the interior of the bushing body 36 (depending on the locking pin design) which groove(s) 40 is/are configured to receive at least one locking pin 28, wherein the locking pin(s) 28 are fixedly and/or retractably attached or mounted on or to the body 26 of the hinge post 22.

The at least one groove(s) 40 is/are transversely formed in or on the bushing body 36 at a position that aligns with the location of the locking pin(s) 28 on the body 26 of the fastening hinge post 22 when the body 26 is within the bushing body 36 for locking or unlocking the locking pin 28 when rotated. The groove(s) 40 capture(s) or release(s) the locking pin 28 when the pin is turned away from its insertion position, such as in a locking pin passage 39 as shown in the longitudinally extending channel 38. Such passages 39 are formed when the locking pin is not retractable to enable slidable entry of the pin through the longitudinally extending channel through the bushing body.

Figure 6A:
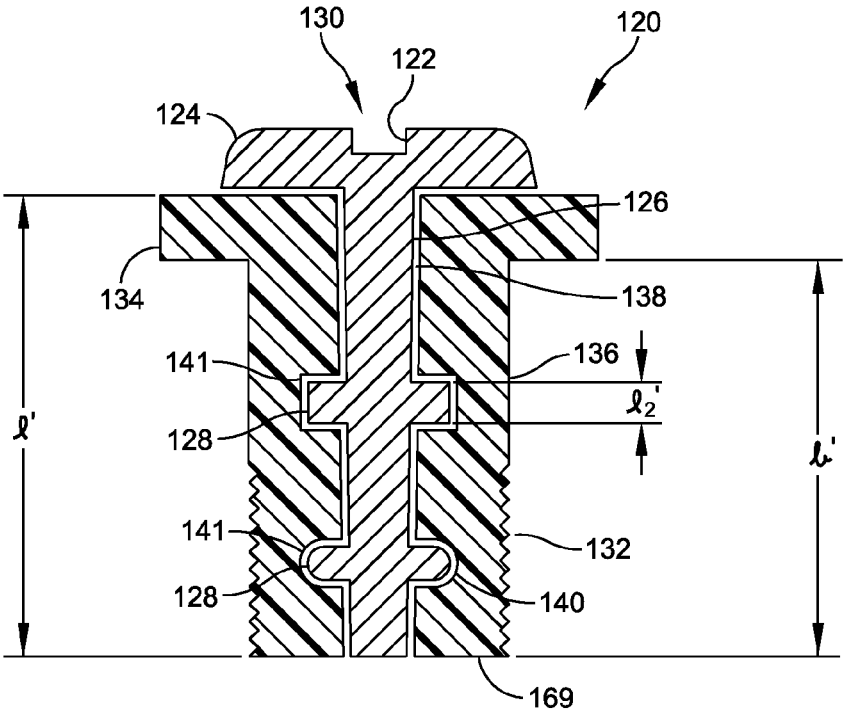
FIG. 6A is a longitudinal cross-sectional side view of a bushing and a fastening hinge post for use in a further alternative embodiment of the hinge assembly of the invention, taken to show the positioning of locking pins in longitudinally extending grooves in the bushing.
Figure 6B:
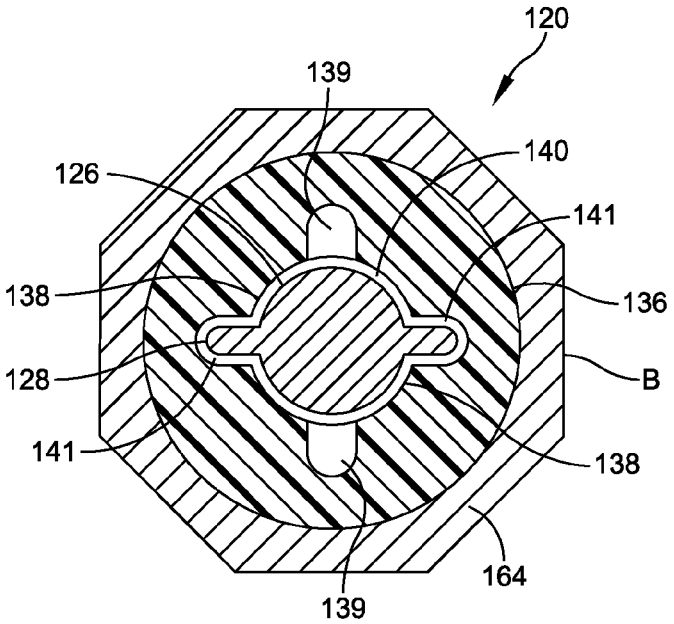
FIG. 6B is a transverse cross-sectional view of the longitudinal extending body of the bushing and hinge post of the embodiment of FIG. 6A with a fastener secured thereon.

As best shown in the alternative embodiment 120 of an assembly otherwise the same as that of FIGS. 1-5B and 7, but having the bushing and hinge post shown in FIGS. 6A and 6B, the transversely extending groove(s) 140 may also have at least one set of locking pin recesses 141 that are sized to snugly fit a locking pin 128 on each side of the fastening hinge post body 126 and/or which extend in an annular groove manner around a carved out interior portion of the hinge post body, which extended recesses or annular groove are such that they would extend outward from the channel 138 transversely into the bushing body 136. Once turned, the locking pin(s) 128 engage the transversely extending groove recesses 141 that are positioned along the inside of the groove 140 or are slid along the inside of an annular groove until the pin(s) 128 is/are not aligned with any locking pin passages 39 in the bushing body (or in the case of a retractable pin, are aligned to expand within the recesses 141 and/or grooves 140.

Preferably, the at least one transversely extending groove 40 as shown in FIGS. 1-5B is partially formed on the bottom 69 of the body 36 of the bushing 32 and has a curvature configured so that the locking pin 28 will be able to rotate into and out of the transversely extending groove 40 or any additionally provided recesses 41 for locking and unlocking.

In an alternative embodiment, when the locking pin 28 is retractably formed so as to be able to be pushed into body 26 of the fastening hinge post 22 before entering the bushing 32 for more easily traveling through the longitudinally extending channel 38, transversely extending groove recesses 41 or at least one groove 40 may be formed separately into the bottom 69 of the bushing body 36 without any internal transversely extending groove 40 or recess 41 and may be formed in a direction preferably disposed and spaced from the locking pin passages 39 for easily rotating the fastening hinge post body 26 and locking pin 28 (once it exits the bottom 69 of the bushing 32 and expands outward from the hinge post 22 to lock and unlock the hinge assembly 20 when the expanded pin is in a recess 41 or groove 40. The groove recesses may be pin receiving holes designed to capture the pin when it is compressed in retracted form and expand into the hole for locking.

In the alternative embodiment 120 of the invention, the hinge assembly is the same in all respects as embodiment 20 for a toilet assembly 10, with the exceptions as noted herein and above, and like numbers refer to like elements throughout. As shown in FIGS. 6A and 6B, there are more than one transversely extending groove 140 positioned at any location along the internal channel 138 of the body 136 of the bushing 132 below the upper flange portion 134 for more receiving more than one locking pin 128 that is attached, preferably in a fixed manner to a hinge post 122. However, a locking pin 128 that is retractably formed into the body 126 of the hinge post 122 may also be used within the scope of this embodiment if optional transversely extending groove recesses 141 are also formed separately into the bushing body 136 for locking and unlocking (or if a circular groove is formed as discussed above) (see FIG. 6B). Preferably such recesses or grooves for locking and receiving the locking pin(s) are positioned in a direction displaced from any locking pin passages 139 formed in the bushing to allow for rotating the fastening hinge post body 126 and the locking pin 128 so as to lock and unlock the hinge assembly 120 within the bushing and/or to operate as described above with respect to a single locking pin and single transversely extending groove.

The body 26 of the fastening hinge post 22 is rotatable inside of the body 36 of the bushing 32 to allow the at least one locking pin 28 to turn and reversibly engage a transversely extending groove recess 41 or groove 40 in the longitudinally extending channel 38. The body 26 of the fastening hinge post 22 is capable of rotating in a locking direction (which may be set up to be either clockwise or counterclockwise depending on design preference) until situated in the at least one transversely extending groove 40 (or other recess, etc.) of the bushing body 36, and preferably rotates about ±1 degree to about ±90 degrees for locking the hinge assembly 20, more preferably about ±45 degrees to about ±90 degrees, upon installation of a toilet seat 10. The fastening hinge post body can also be made to be rotatable 360° or to have a groove with a stop for limiting travel past a certain point as desired.

To remove a toilet seat 10, the body 26 of the fastening hinge post 22 is capable of rotating reversibly in a direction opposite the locking direction within the at least one transversely extending groove 40 or other recess in the bushing body 36, preferably over the same rotational distance and in a direction opposite the locking direction, i.e., preferably about ±1 degree to about ±90 degrees, and more preferably about ±45 degrees to about +90 degrees for unlocking the hinge assembly 20 of a toilet seat 10.

Figure 7A:
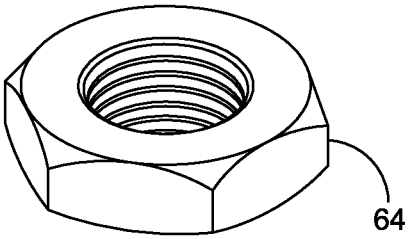
FIG. 7A is a perspective view of a fastening device for use with an embodiment of the invention such as that of FIG. 1.
Figure 7B:
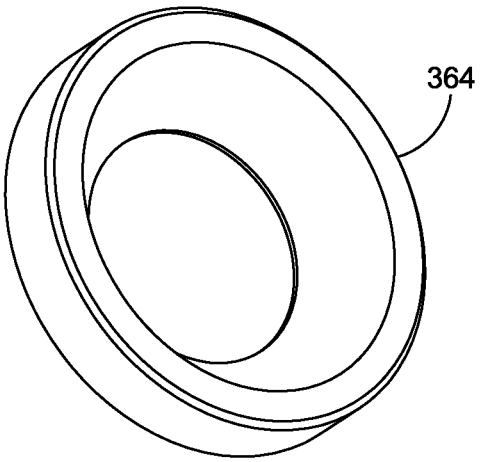
FIG. 7B is a perspective view of a fastening device according for use in an embodiment of the invention.
Figure 8:
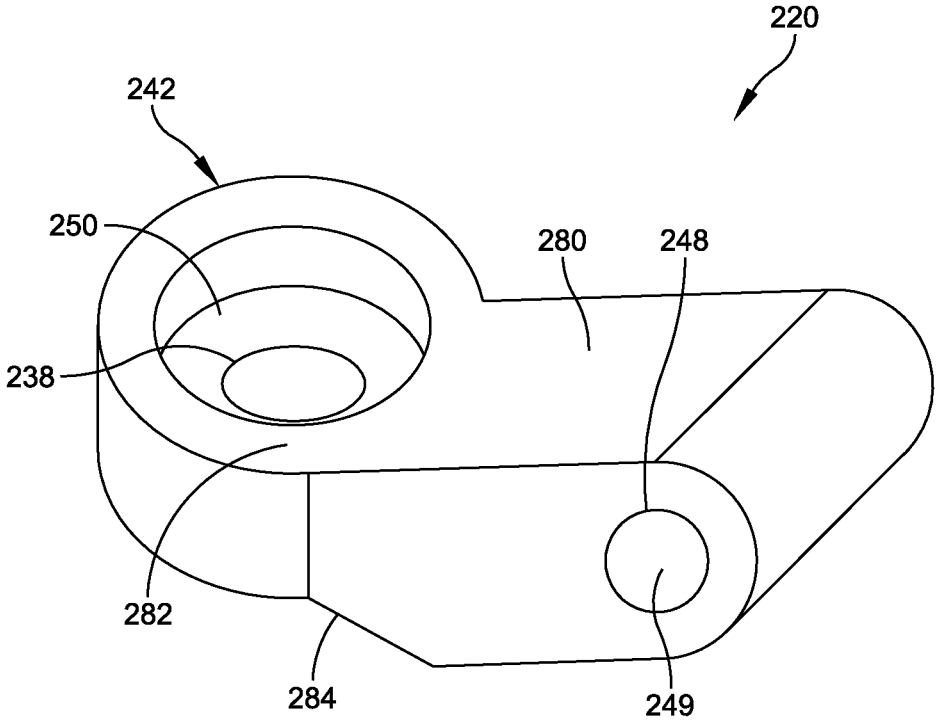
FIG. 8 is a perspective view of a hinge body according to a further embodiment of the invention.
Figure 9:
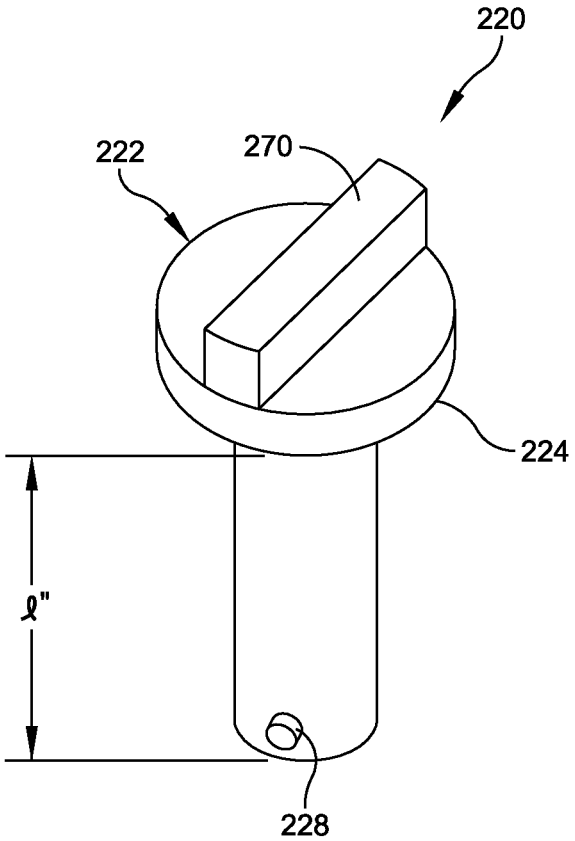
FIG. 9 is a perspective view of a fastening hinge post according to another embodiment of the invention.
Figure 10:
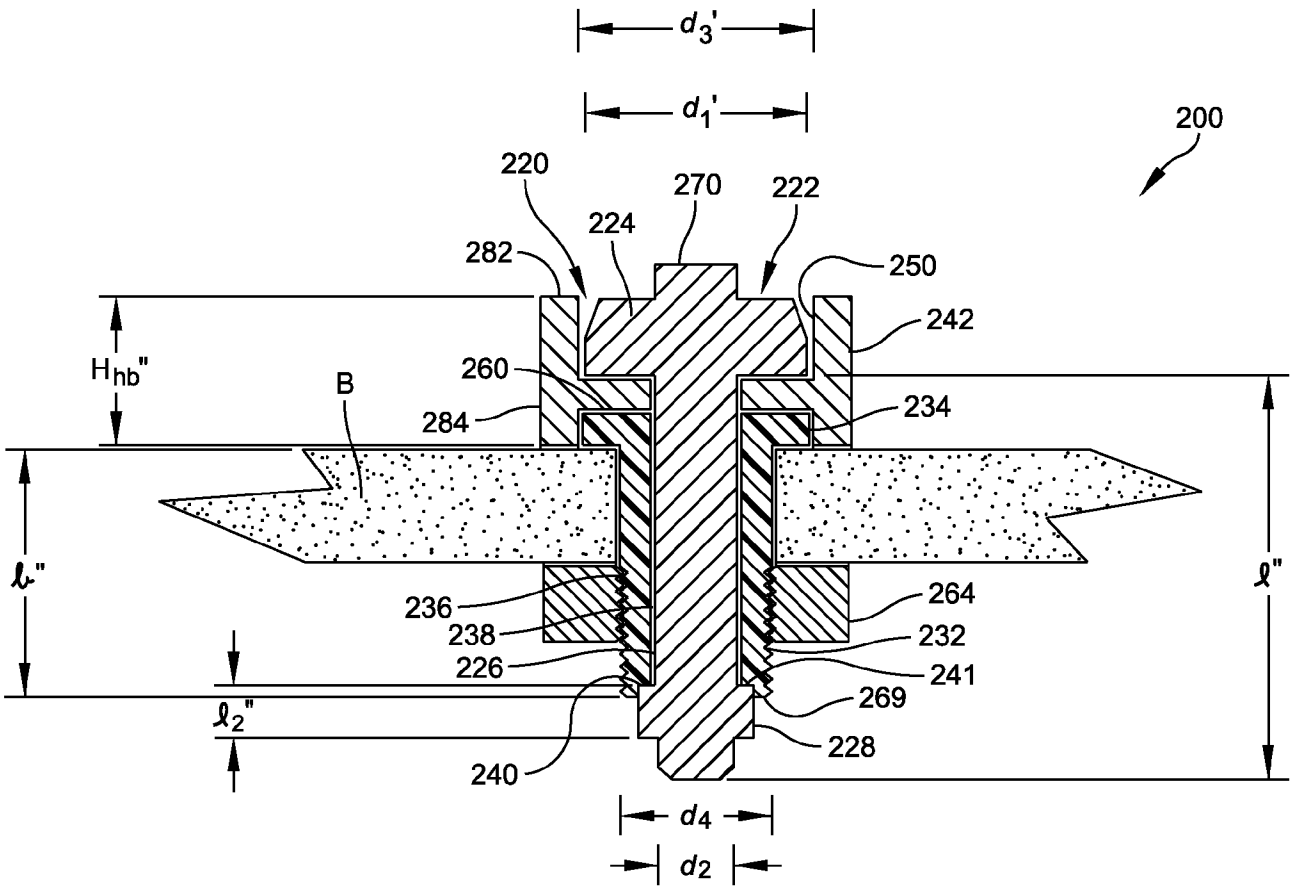
FIG. 10 is a is a longitudinal cross-sectional view of the toilet seat hinge assembly according to an embodiment of the hinge assembly using a hinge post as in FIG. 9 as installed on a toilet, taken through the assembly showing the locking pins in the transversely extending grooves.

The body 36 of the bushing 32 has an outer surface 66 that can, in one embodiment, be machined or formed preferably to have threads 68 for mating with corresponding threads on a fastening device 64, such as a nut, cap, etc., however other fasteners such as clamps, clasps, clips, ties, and any fasteners known or to be developed in the art may be used as a fastening device herein. In an alternative embodiment, the outer surface of the bushing body can be smooth for mating with a fastening device that is applied by snap or tight fit, such as an o-ring in an alternative embodiment 300, having a hinge assembly 320 which is in all respects the same as that of embodiment 10 and assembly 20 with the exception of a fastening device 364 as shown in FIG. 7B. It is possible to also use a collapsible bushing, but for such a design special tools would be needed for the installation.

Figure 4:
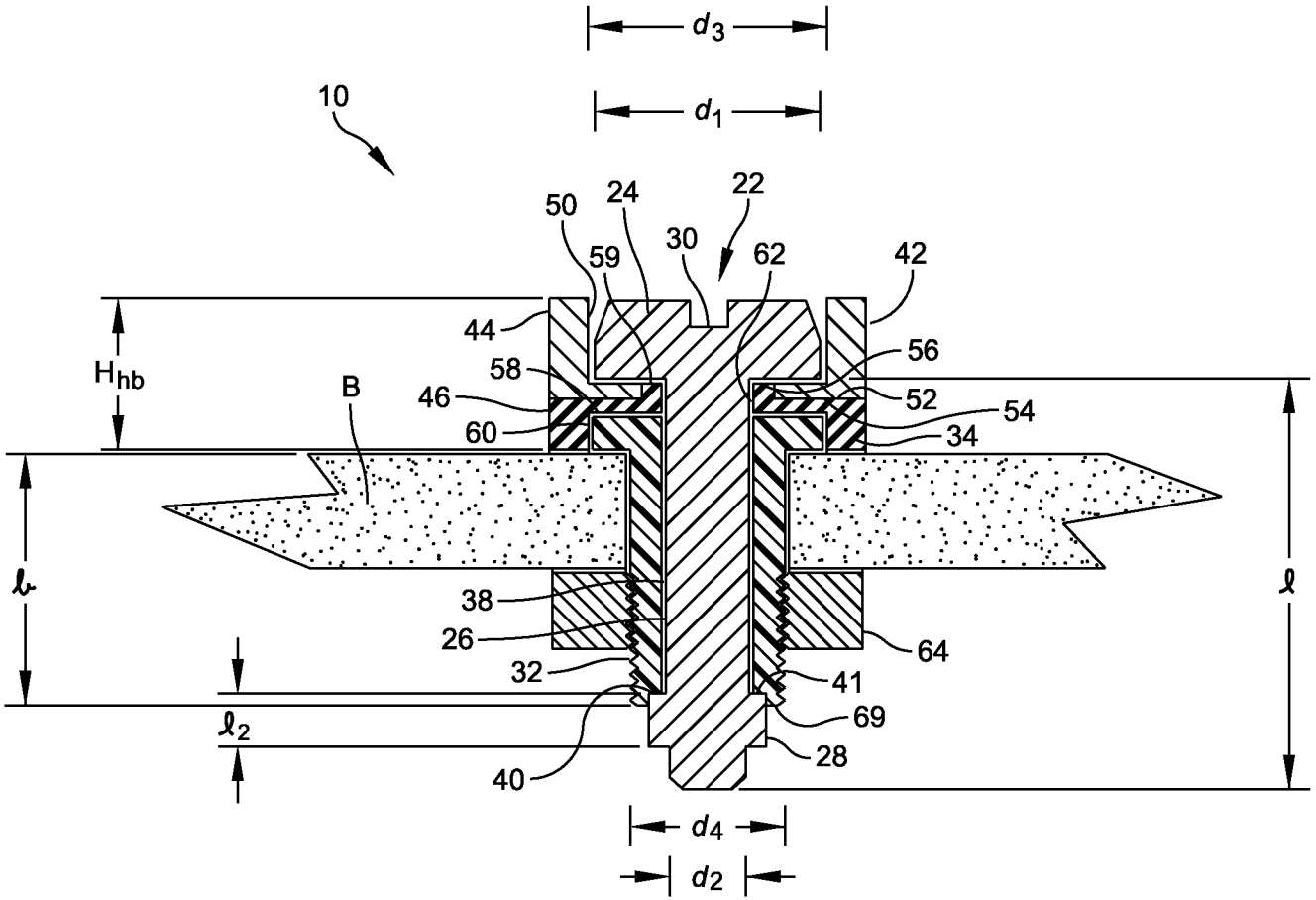
FIG. 4 is a longitudinal cross-sectional view of the toilet seat hinge assembly of FIG. 1 as installed on a toilet in a mounting hole, taken through assembly at the location where the locking pin is situated in the transversely extending groove.

The hinge body 42 is a central hub for several parts of the hinge assembly, and more particularly for seating the head 24 of the fastening hinge post 22, and the upper flange portion 34 of the bushing 32, while also attaching the toilet seat 10 to the hinge assembly 20 for installing a seat on a toilet. The hinge body 42 can be formed by molding or otherwise forming materials that are fluid-resistant and preferably not susceptible to corrosion, for example, aluminum, copper, alloys including, e.g., steel, bronze and brass, or moldable composites, moldable polymeric materials, and/or combinations of these materials, including filled and unfilled polypropylene, polyurea, polyethylene, polystyrene, polyvinyl chloride (PVC) and polytetrafluoroethylene (PTFE) as well as copolymers and blends of these materials. In a preferred embodiment, the hinge body 42 is formed from polypropylene. The hinge body 42 preferably has a height $H_{hb}$ measured longitudinally from the top of the wall of the seat 50 in the upper section 44 through the bottom of the lower section 46 as shown in FIG. 4 of about 1.2 cm to about 3.0 cm, and more preferably about 1.2 cm to about 2.5 cm depending on the design and preferably to accommodate grooves and channels and avoid excessive protrusion of the hinge assembly 20 near the back of the toilet which may interfere with the opening and closing of the seat and lid, the cleaning of the seat and lid or affect the aesthetic appearance of the lid.

In one embodiment, the hinge body 42 of the hinge assembly 20 has an upper section 44 and a lower section 46. The sections can be separate pieces adhered or fastened together or portions of a unitarily formed body as discussed in detail above. The upper section 44 preferably includes a hinge pin receiving portion 48 which is configured to receive a hinge pin from a toilet seat 10. The upper section 44 also preferably defines the at least one seat 50 configured to receive the head 24 of the fastening hinge post 22. Preferably, the hinge pin receiving portion 48 further includes a channel 49 configured for receiving a hinge pin of a toilet seat 10. The channel 49 of the hinge pin receiving portion 48 is configured for receiving the hinge pin of the toilet seat 10 by any manner of connection as is known in the art or to be developed, and preferably by either a sliding in, snap-in fit or a friction fit, more preferably by a snap-in fit. This also allows for the toilet seat 10 to be removable while the hinge assembly stays in place for better access to difficult areas of the seat 10 and bowl B that require thorough cleaning.

The lower section 46 of the hinge body 42 in one embodiment wherein the sections are separate pieces may have an upper surface 52 that is fastened or adhered in facing engagement to a lower surface 54 of the upper section 44. The lower section preferably also has a centrally situated fastening hinge post receiving insert 56 as shown in the embodiment 20, which extends into the seat 50 of the upper section 44 configured to receive a fastening hinge post head 24. The insert 56 is shaped and sized to fit inside of the seat 50 in the upper section 44. The insert 56 also has a longitudinally extending channel 59 therethrough which has the same or similar dimensions to those of the body 36 of the bushing 32 so as to also receive the body 26 of the fastening hinge post 22 therethrough. The lower section preferably also has a lower surface 58 defining a seat 60 configured to receive the upper flange portion 34 of the bushing 32.

The hinge body 42 has a central opening 62 that extends longitudinally therethrough from the seat 50 of the upper section 44 and through the fastening hinge post receiving portion and is configured to receive the fastening hinge post body 26 therethrough.

An alternative embodiment 220 is also within the scope of the invention for use with a toilet assembly 200, wherein the toilet and lid are the same as toilet assembly 10, and the hinge assembly 220 is the same with the exceptions as described herein, and wherein like numbers refer to like elements throughout. As shown in FIGS. 8-11C, the hinge body 242 is formed as a unitary structure which may or may not have an inclined wall 280 comprising a hinge pin receiving portion 248, which further includes a hinge pin receiving piece channel 249 configured for receiving a hinge pin on a toilet seat 210. The channel 249 can be formed as completely enclosed in the rear the hinge body 242 for insertion of the hinge pin on the toilet seat 210, or it can be configured to be partially accessible on an upper surface of the inclined wall 280 for receiving the hinge pin of the toilet seat and lid assembly 210 by any method of connection as is known or to be developed in the art, and preferably by sliding in, snap fit or friction fit, more preferably by snap fit. However, for a channel within the body, the hinge pin may be a sliding fit.

The upper surface 282 of the hinge body 242 also defines at least one seat 250 configured to receive the head 224 of the fastening hinge post 222. The lower surface 284 of the unitary hinge body 242 also defines at least one seat 260 configured to receive an upper flange portion 234 of a bushing 232. This embodiment may also have one or more fastening pins 228. The hinge body 242 has a central opening 262 extending longitudinally therethrough from the top of the seat 250 of the upper surface 280 and through lower surface 284, wherein the central opening 262 of the hinge body 242 is configured to receive the body 226 of the fastening hinge post 222 therethrough.

The invention in any embodiment herein may also include at least one threaded fastening device 64 (see FIG. 7A for example) for securing the hinge assembly 20 to a toilet by mating with threads or other compatible fastening mechanism on a corresponding body 36 of a bushing 32. Typical hardware for fastening devices are any that are known or to be developed in the art including a nuts (as shown in FIG. 7A), caps, clamps, clasps, clips, and ties. Alternatively, the fastening device 364 as shown in FIG. 7B can be a slide connector or o-ring as shown in FIG. 7B for use when a bushing body is formed that is smooth on its exterior. Fastening devices, such as those well known in the art, can also be formed by molding or otherwise forming materials that are fluid-resistant and preferably are not susceptible to corrosion, for example, aluminum, copper, alloys including, e.g., stainless steel, bronze and brass, moldable composites, and moldable polymeric materials, and/or combinations of these materials. Suitable moldable materials include polyethylene, polypropylene, polyvinyl chloride (PVC), and polytetrafluoroethylene (PTFE) as well as copolymers and blends of these materials.

In one embodiment, the fastening device 64 is formed from polyvinyl chloride (PVC). In a preferred alternative embodiment, the fastening device 64 is formed from brass.

Figure 11B:
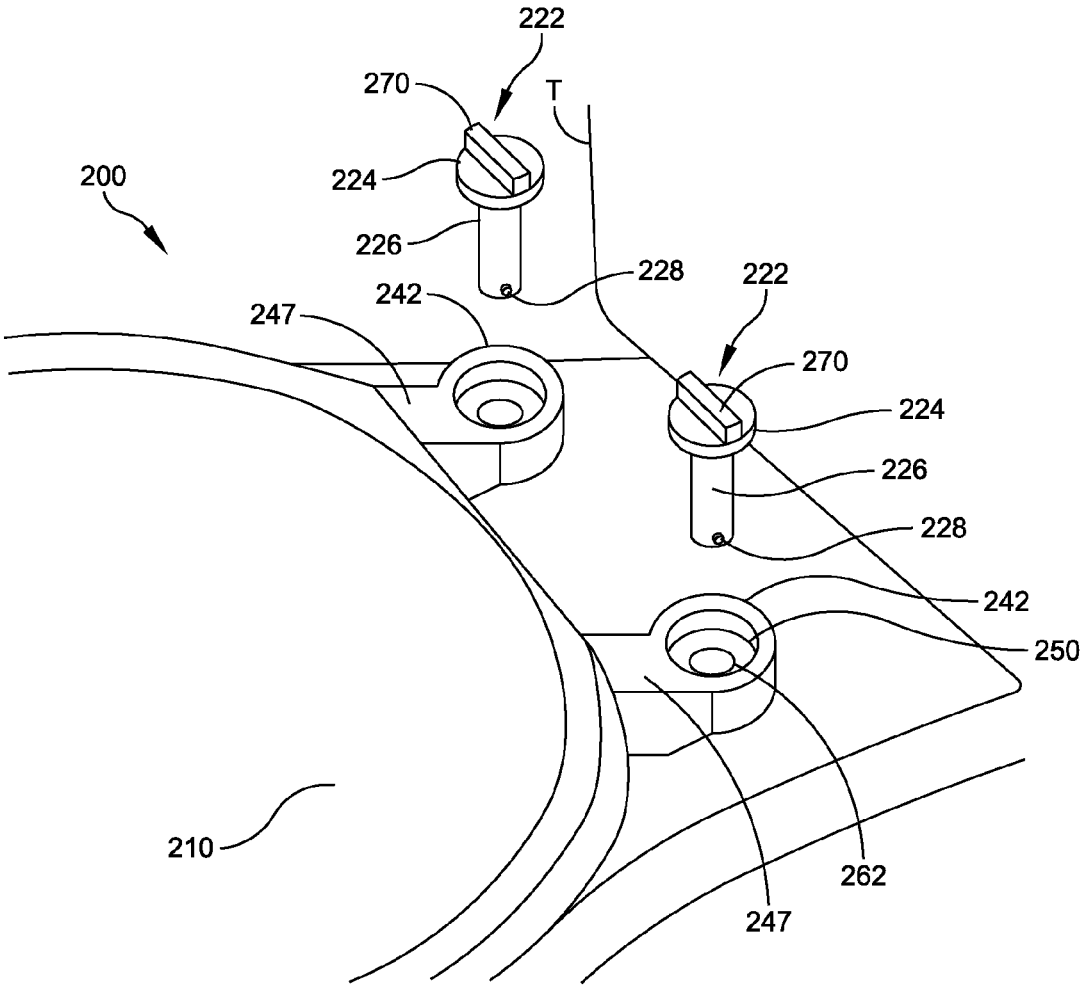
FIG. 11B is a perspective representation showing inserting the fastening hinge post of the assembly of FIG. 10 through the hinge body and bushing.
Figure 11C:
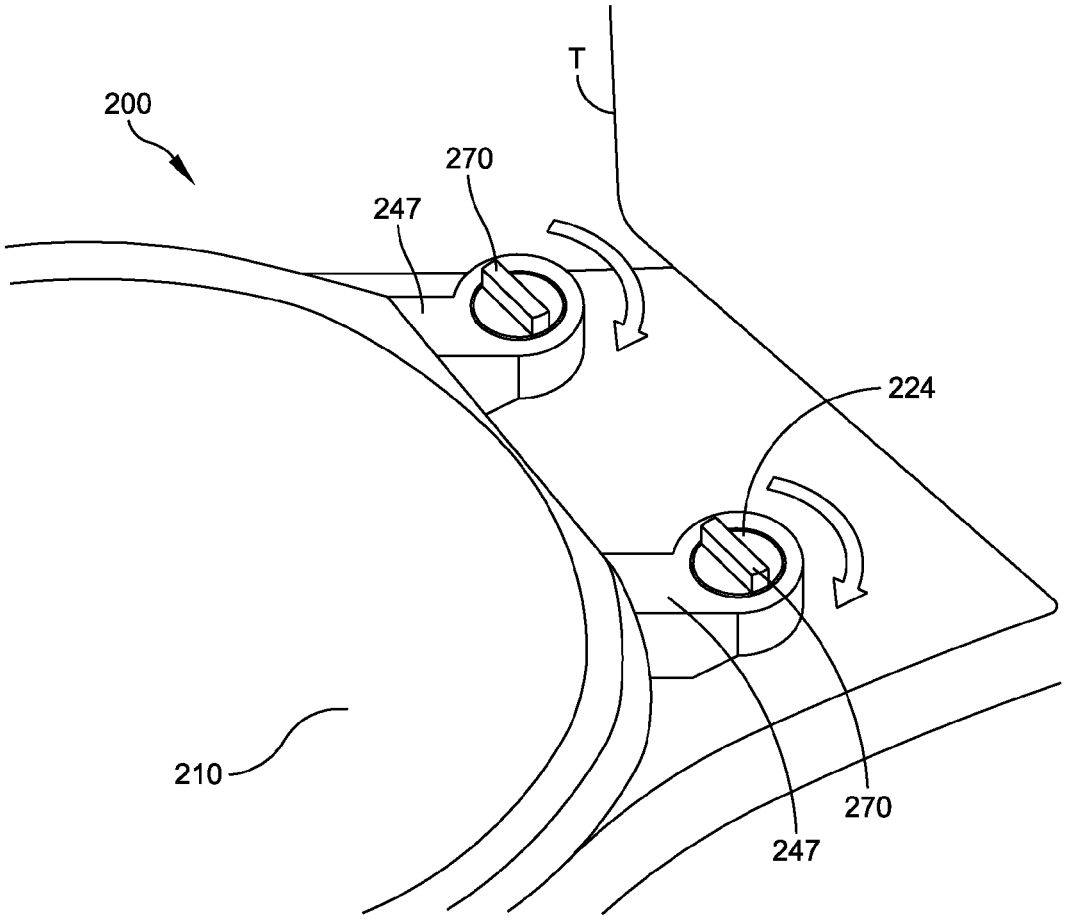
FIG. 11C is a perspective representation showing rotating the fastening hinge post of 11B to lock the hinge assembly.

In an embodiment of the method of the invention herein, after providing, such as by manufacturing, a toilet seat 10 (which may be a single toilet seat or toilet seat and lid assembly) and providing a toilet seat hinge assembly 20, such as any of the hinge assembly embodiments described herein and within the scope of the invention, the method will now be described in further steps with reference to embodiment 20. A bushing 32 of a hinge assembly 20 is positioned into a mounting hole on an installation surface of a toilet T. This is shown in FIG. 11A. The hinge assembly 20 may then be secured underneath the installation surface and beneath the mounting hole using at least one fastening device 64 either before or after attaching the toilet seat 10. Next, the hinge body 42 is placed over the bushing, preferably so that the upper flange portion 34 is positioned inside a seat 60 in the lower portion of the hinge body and covers the mounting hole as shown in FIG. 11B. The fastening hinge post 22 is then inserted through the hinge body 42 by way of the central opening 62 and until the hinge post head is within the upper seat 50 of the hinge body, upon which the body 26 of the hinge post 22 will be within the body 36 of bushing 32 and the at least one locking pin 28 of the hinge post 22 will be aligned near the transversely extending groove (either in a retracted form or within a locking pin passage). The fastening hinge post 22 when in place is rotated by using a gripping tab or a tool in a slot, etc. until the at least one locking pin is within the at least one transversely extending groove 40. User rotation of the hinge post head rotates the fastening hinge post body 26 and locking pin 28 so that the pin may either position itself inside of a locking pin recess 41 in the bushing body 36 or a groove 40 in or on the bushing body or in a circular recess within the body. Rotation for locking is shown in FIG. 11C. Upon locking, the assembled hinge assembly 20 is installed in place on the toilet. The toilet seat (or seat and lid assembly) 10 is mounted on the hinge assembly, for example by positioning the lid on the at least one toilet seat hinge assembly 22 using a mating mechanism, e.g., by inserting a hinge pin on the toilet seat 10 into a channel 49 of a hinge pin receiving portion 48 of the hinge body 42.

To remove the hinge assembly 20 and a toilet seat and lid assembly 10 after installation, the head 24 of the fastening hinge post 22 is then rotated in a direction opposite the locking direction, which will remove the locking pin from the groove 40 and/or disengage the locking pin 28 from any locking pin recesses 41 or groove within the bushing. This reversibly rotates the fastening hinge post body 26 and locking pin 28 and unlocks the hinge assembly 20. Then the seat may be removed and the hinge assembly detached if desired for further cleaning.

If 360° rotation of a locking pin is preferred, such locking can be accommodated to note lock and unlock positions by using stops or a detent and groove arrangement.

For cleaning the bushing body 32 and fastening device 64 may remain in place if desired for reattachment of the hinge assembly 20 once the area underneath the assembly has been cleaned or for replacement of either the hinge assembly or toilet lid.

The method herein may be practiced on any of the embodiments herein; however, for convenience, an exemplary embodiment of the method is described herein with reference to the hinge assembly 20, embodied in FIGS. 1-5B and 7A. Analogous parts in alternative embodiments may also be used if practicing the invention using other embodiments. Unlike prior methods and assemblies, the toilet seat hinge assembly may be used with prior art toilets and other existing methods, kits, or assemblies that incorporate such a device. However, the method as described herein is a preferred method and not intended to be limiting.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A toilet seat hinge assembly for a toilet bowl, comprising:

a fastening hinge post having a head and a longitudinally extending body having at least one locking pin;

a bushing having an upper flange portion, a longitudinally extending body, the body defining a longitudinally extending channel therethrough that is configured to receive the fastening hinge post body and at least one locking pin, and at least one transversely extending groove in or on the bushing body configured for receiving the at least one locking pin;

a hinge body defining a seat configured to receive the fastening hinge post head;

a central opening extending longitudinally through the seat of the hinge body, wherein the central opening is configured to receive the fastening hinge post body and the at least one locking pin therethrough; and at least one fastening device for securing the hinge assembly to a toilet, wherein the at least one locking pin is configured to lock by rotating the fastening hinge post body within the longitudinally extending channel of the bushing body until the locking pin is positioned within the at least one transversely extending groove.

2. The toilet seat hinge assembly for a toilet bowl according to claim 1, wherein the locking pin is configured to unlock by rotating the fastening hinge post body within the channel of the bushing body in a direction opposite of a locking rotation direction until the locking pin is no longer positioned within the at least one transversely extending groove.

3. The toilet seat hinge assembly for a toilet bowl according to claim 1, wherein the hinge body is formed as a unitary structure.

4. The toilet seat hinge assembly for a toilet bowl according to claim 1, wherein the hinge body further comprises a hinge pin receiving portion configured to receive a hinge pin.

5. The toilet seat hinge assembly for a toilet bowl according to claim 4, wherein the hinge body comprises an upper section and a lower section, the upper section comprising the hinge pin receiving portion and the seat, and the lower section having an upper surface in facing engagement with a lower surface of the upper section, and having on a lower surface thereof a fastening hinge post receiving insert that extends through the seat of the upper section to the lower surface, wherein the fastening hinge post receiving insert is configured to receive the upper flange portion of the bushing.

6. The toilet seat hinge assembly for a toilet bowl according to claim 4, wherein the hinge pin receiving portion comprises a channel configured for receiving a hinge pin of a toilet seat or toilet seat and lid assembly.

7. The toilet seat hinge assembly for a toilet bowl according to claim 1, wherein the fastening hinge post comprises a material selected from the group consisting of aluminum, aluminum alloys, copper, copper alloys, moldable composites, moldable polymeric materials, and combinations thereof.

8. The toilet seat hinge assembly for a toilet bowl according to claim 7, wherein the moldable polymeric materials are selected from the group consisting of polyethylene, polypropylene, polyvinyl chloride (PVC), moldable fluoropolymers, and blends and copolymers thereof.

9. The toilet seat hinge assembly for a toilet bowl according to claim 7, wherein the fastening hinge post comprises brass.

10. The toilet seat hinge assembly for a toilet bowl according to claim 1, wherein the fastening hinge post body is capable of rotating within the at least one transversely extending groove of the bushing body about ±1 degree to about ±90 degrees for locking the assembly.

11. The toilet seat hinge assembly for a toilet bowl according to claim 10, wherein the fastening hinge post body is capable of rotating within the at least one transversely extending groove of the bushing body about ±45 degrees to about ±90 degrees for locking the assembly.

12. The toilet seat hinge assembly for a toilet bowl according to claim 10, wherein the fastening hinge post body is further capable of rotating within the at least one transversely extending groove of the bushing body about ±1 degree to about ±90 degrees for unlocking the assembly in a direction opposite a direction for locking the hinge assembly.

13. The toilet seat hinge assembly for a toilet bowl according to claim 12, wherein the fastening hinge post body is capable of rotating within the at least one transversely extending groove of the bushing body about ±45 degrees to about ±90 degrees for unlocking the assembly in a direction opposite a direction for locking the hinge assembly.

14. The toilet seat hinge assembly for a toilet bowl according to claim 1, wherein the bushing comprises a material selected from the group consisting of aluminum, copper, stainless steel, brass, bronze, moldable composites, moldable polymeric materials including polyethylene, polypropylene, polystyrene, polyvinyl chloride (PVC), and polytetrafluoroethylene (PTFE) and copolymers thereof, and/or combinations thereof.

15. The hinge assembly according to claim 14, wherein the bushing comprises polyvinyl chloride (PVC).

16. A method of installing a toilet seat on a toilet, comprising:

(a) providing a toilet seat having a toilet seat hinge;

(b) providing at least one toilet seat hinge assembly comprising:

a fastening hinge post having a head and a longitudinally extending body having at least one locking pin;

a bushing having an upper flange portion, a longitudinally extending body, the body having a longitudinally extending channel therethrough configured to receive the fastening hinge post body and the at least one least one locking pin, and at least one transversely extending groove in the bushing body configured for receiving the at least one locking pin;

a hinge body defining a seat configured to receive the fastening hinge post head;

a central opening extending longitudinally through the seat of the hinge body, wherein the central opening is configured to receive the fastening hinge post body and the locking pin therethrough; and at least one fastening device for securing the hinge assembly to a toilet, wherein the at least one locking pin is configured to lock by rotating the fastening hinge post body within the channel in the bushing body until the locking pin is positioned within the at least one transversely extending groove;

(c) positioning the bushing into a mounting hole in a toilet;

(d) securing the bushing within a mounting hole in a toilet with the fastening device;

(e) placing the hinge body over the bushing;

(f) inserting the fastening hinge post through the hinge body and the longitudinally extending channel of the bushing body until the fastening hinge post head is within the seat;

(g) rotating the fastening hinge post until the at least one locking pin is within the at least one transversely extending groove to lock the hinge assembly; and (h) mounting the toilet seat hinge on the hinge assembly.

17. The method of installing a toilet seat according to claim 16, wherein the hinge body comprises a lower seat portion configured to receive the upper flange portion of the bushing and step (e) further comprises placing the hinge body over the bushing so that the upper flange portion of the bushing is situated in the lower seat portion of the hinge body.

18. The method of installing a toilet seat according to claim 16, wherein the toilet seat is part of a toilet seat and lid assembly.

19. The method of installing a toilet seat according to claim 16, wherein there are two hinge assemblies and step (b) includes providing two hinge assemblies and steps (c) through (g) are carried out for each of the hinge assemblies.

20. The method of installing a toilet seat according to claim 19, wherein each of the two hinge bodies of the two hinge assemblies has a hinge pin receiving portion configured to receive a hinge pin, the toilet seat has a hinge pin and step (h) further comprises positioning the toilet seat hinge in the hinge pin receiving portions of the hinge bodies.

21. The method of installing a toilet seat according to claim 16, wherein the hinge body has a hinge pin receiving portion configured to receive a hinge pin, the toilet seat has a hinge pin and step (h) further comprises positioning the toilet seat hinge in the hinge pin receiving portions of the hinge bodies.

22. The method of installing a toilet seat according to claim 16, wherein step (g) further comprises rotating the fastening hinge post about ±1 degrees to about ±90 degrees.

23. The method of installing a toilet seat according to claim 22, wherein step (g) further comprises rotating the fastening hinge post about ±45 degrees to about ±90 degrees.

24. The method of installing a toilet seat according to claim 16, further comprising the step of unlocking the hinge assembly for removal of the installed toilet seat by rotating the fastening hinge post in a direction opposite a locking direction for the hinge assembly to unlock the hinge assembly.

* * * * *